United States Patent [19]

Sulprizio

[11] Patent Number: 4,839,236

[45] Date of Patent: Jun. 13, 1989

[54] INGOT FORM

[76] Inventor: Lucelio Sulprizio, 3059 Frandoras Cir., Oakley, Calif. 94561

[21] Appl. No.: 48,369

[22] Filed: May 11, 1987

[51] Int. Cl.[4] ..... B22D 7/00

[52] U.S. Cl. ..... 428/576; 428/583; 428/584

[58] Field of Search ..... 428/577, 582, 583, 584, 428/585, 586, 588, 589, 576; 164/DIG. 6; D15/144

[56] References Cited

U.S. PATENT DOCUMENTS

| | | | |
|---|---|---|---|
| 2,083,913 | 6/1937 | Jung | 428/582 |
| 2,157,097 | 5/1939 | Jung | 428/584 |
| 2,174,562 | 10/1939 | Berg | 428/585 |
| 2,252,808 | 8/1981 | Jung | 428/583 |
| 2,447,437 | 8/1948 | Smith | 428/582 |
| 3,161,477 | 12/1964 | Chambran | 428/585 |
| 3,674,444 | 7/1972 | Otani | 428/586 |
| 3,681,048 | 8/1972 | Otani | 428/576 |

FOREIGN PATENT DOCUMENTS

| | | | |
|---|---|---|---|
| 770793 | 3/1957 | United Kingdom | 428/588 |

*Primary Examiner*—John J. Zimmerman

*Attorney, Agent, or Firm*—I. Michael Bak-Boychuk

[57] ABSTRACT

An ingot formed as an elongate structure characterized by a rectangular center body and reduced section handle structures on the ends of the body each provided with recesses for receipt of manipulative tools. The rectangular center body moreover, includes performations proximate each handle structure which are useful in storage and for the control of heat transfer for partial melting.

5 Claims, 1 Drawing Sheet

INGOT FORM

BACKGROUND OF THE INVENTION

1. Field of the Invention

The present invention relates to casting forms, and more particularly to ingot shapes useful both in the manipulation of the ingot and its absorption of heat.

2. Description of the Prior Art

In the art of metal casting traditional shapes have been evolved for the shape of an ingot. Most frequently such shapes were devised as a consequence to casting convenience, storage convenience, and the convenience in manipulation of the ingot prior to melting. Thus metal ingots have acquired generally trapezoidal forms with a large rectangular base, a form which is easily molded and which lends itself for easy or convenient removal from the mold. These trapezoidal forms, while suitable for their purposes, are particularly adapted for complete melting and thus do not provide manipulative convenience.

In many applications only a limited mass of molten material is required. For example, where single or unitary articles are cast for a specialized, non-recurring application only a small quantity of molten metal may be required. The volumetrically compact prior art ingots often do not provide the necessary convenience for partial melting and those engaged in the business of specialty castings often melt more material than is necessary for a particular event.

Accordingly, ingot shapes conformed for manipulative insertion into the source of melting heat are desired, particularly if other conveniences of storage, packaging and stacking are also availed. It is one such ingot form that is disclosed herein.

SUMMARY OF THE INVENTION

Accordingly, it is the general purpose and object of the present invention to provide an ingot form particularly suited for manipulative convenience.

Other objects of the invention are to provide an ingot shape conformed for heat transfer controlled by geometry.

Yet further objects of the invention are to provide an ingot shape which is useful both in storage and in the course of melting.

Briefly, these and other objects are accomplished within the present invention by providing a substantially rectangular ingot configuration including at the longitudinal ends thereof reduced thickness handle structures adjacent perforations in the body of the ingot. In section the foregoing ingot shape includes the necessary draft for mold removal and the handle geometry is selected for an increased surface-to-volume ratio to effect early melting. Moreover, the perforations in the body of the ingot adjacent each handle reduce the heat transfer section thereacross and thus are useful in controlling heat propagation. The handles are thus useful for manual convenience or for receipt of tools for the manipulation of the ingot over or adjacent the melting pot and the perforations allow for stacking convenience of the ingots onto dowels or posts.

In this form an ingot shape is devised which may be easily manipulated and which, moreover, may be controlled in the melt propagation therein to effect partial melting. In consequence those engaged in producing cast articles can select the amount of material molten from the ingot, the geometry useful in providing such selection being also convenient in stacking and storage.

DESCRIPTION OF THE SPECIFIC EMBODIMENT

Figure 1:
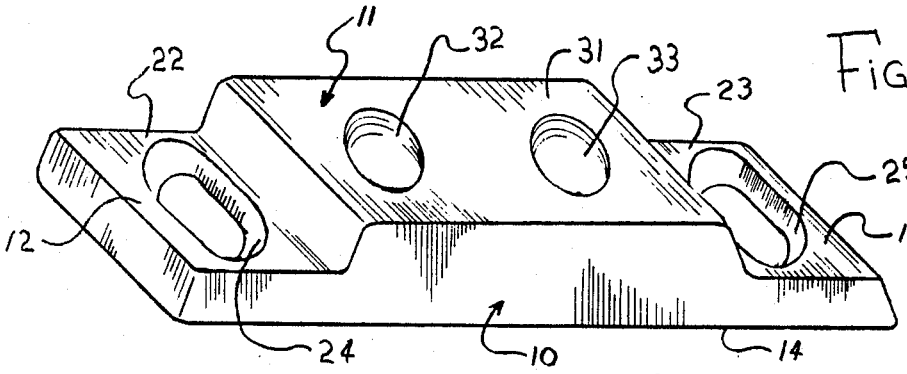
FIG. 1 is a perspective illustration of an ingot configuration constructed in accordance with the present invention.
Figure 2:
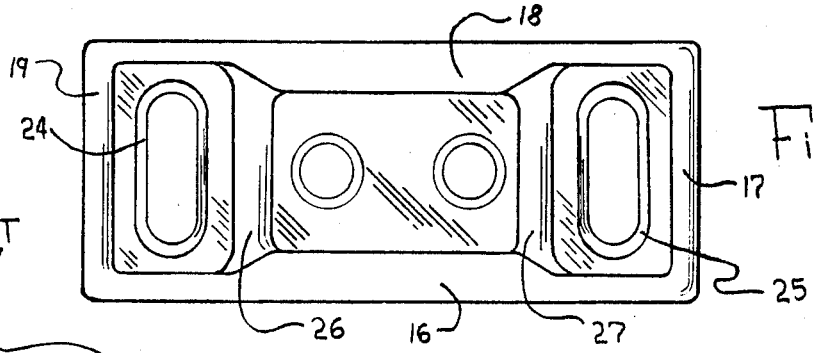
FIG. 2 is a top view of the inventive ingot shown in FIG. 1.
Figure 3:
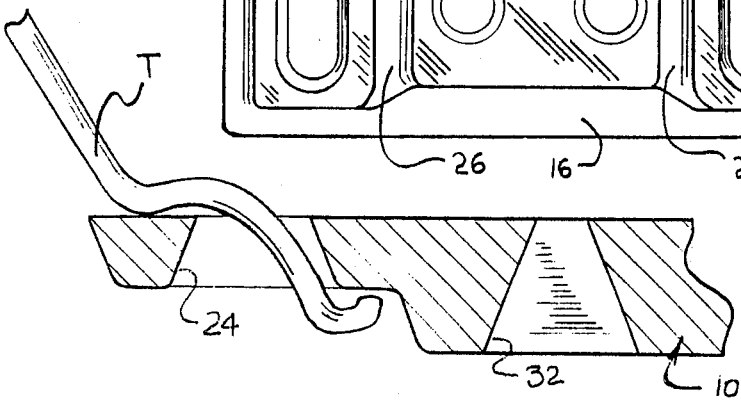
FIG. 3 is a sectional detail, in side view, illustrating the tool manipulation of the inventive ingot.

As shown in FIGS. 1 through 3 the inventive ingot, generally designated by the numeral 10, comprises a rectangular, enlarged, central body section 11 interposed between distal, reduced thickness handle structures 12 and 13 formed at the longitudinal ends thereof. Handle structures 12 and 13 and the center body 11 share a common lower surface 14 of a generally rectangular platform. An inwardly tapering lateral, peripheral surface shown at 16, 17, 18 and 19 then defines the lateral edges of article 10, tapered or aligned from the base surface 14 on a draft to allow removal from a mold. This lateral edge surface, comprising the foregoing segments reduces in height at the handle structures 12 and 13 as shown by corresponding handle top surfaces 22 and 23. These surfaces 22 and 23 surround, in turn, transversely elongated handle holes 24 and 25 which; once again, are set at a taper to allow for the removal from a mold. Surfaces 22 and 23, moreover, join across inclined segments 26 and 27 to the top surface 31 of the central body 11. Thus the central body 11 is raised above the plane of surfaces 22 and 23 by an increment substantially equal to the thickness of the handles. Two tapered holes 32 and 33 then extend through the body 11 each spaced adjacently to the corresponding inclined surface 26 and 27 and each, thereby, reducing the sectional area of the ingot 10.

Figure 4:
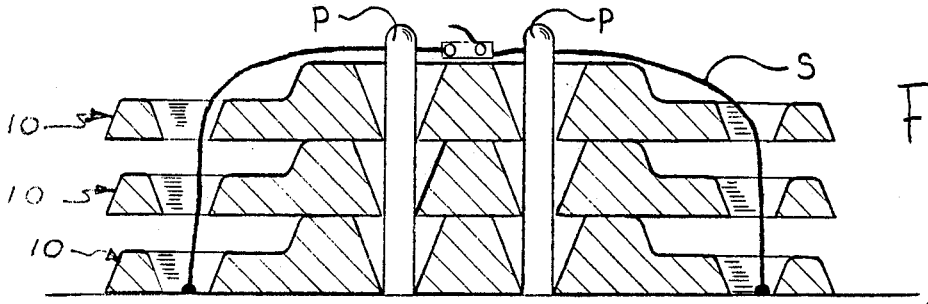
FIG. 4 is a side view of a stack of ingots disclosed herein secured for storage and transport.

A tool T may then be inserted as illustrated in FIG. 3 to grasp and lever in one of the handle openings 24 or 25 and the ingot may thus be manipulated. In the course of the manipulation various portions of the ingot may be exposed to the heat source and the ingot can thus be progressively melted for use. Of course the higher surface to volume ratio of the handles will cause the earlier melting thereof and thereafter melting will occur sequentially to the reduced sections at each of the holes 32 and 33. In this manner a structure is formed by which the use of the metal in the ingot is controlled and which moreover is available for effecting storage. For example, as shown in FIG. 4 the ingots 10 may be stacked for storage on posts P spaced to pass through openings 32 and 33 and a strap S may be used to bind the ingots thus stored together.

Figure 5:
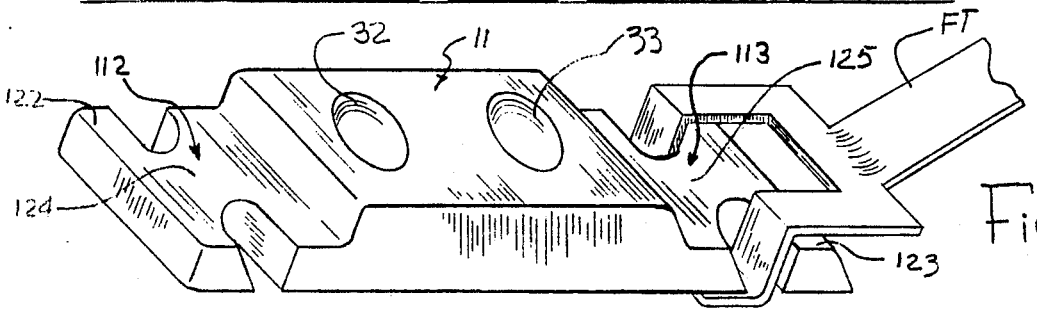
FIG. 5 is another perspective illustration of an alternative ingot structure in accordance with the present invention.

As shown in FIG. 5 an alternative handle structure in the form of a T may be implemented illustrated as handle structure 112 and 113 and comprising a center piece 124 and 125 extending to a transverse piece 122 and 123. Once again a fork to FT may engage the cantilevered end piece segments for manipulation. Of course the remaining structure designated by like numerals is similarly implemented and similarly used.

In this manner an ingot structure conveniently manipulated and conveniently stored is devised with little added cost and expense.

Obviously, many modifications and changes may be made to the foregoing without departing from the spirit of the invention. It is therefore intended that the scope of the invention be determined solely on the claims appended hereto.

What is claimed is:

1. A metal ingot, comprising:

a rectangular elongate center body extending between longitudinal ends and characterized by tapered peripheral edges extending between said longitudinal ends and a first and second handle structure extending from said longitudinal ends of said center body each said handle being formed to a thickness less than half of the thickness of said center body and including recesses therein, and said center body having formed therein a first and second opening respectively adjacent said first and second handles for reducing the section of said center body thereat to control the heat transfer therethrough.

2. A metal ingot according to claim 1 wherein:

said recesses in said first and second handle structures each include an elongate aperture defined by a tapered exterior and interior edge.

3. A metal ingot according to claim 1 wherein said recesses in aid first and second handle structures each include lateral apertures extending towards each other.

4. An ingot form useful in controlling the heat transfer from one end thereof to the other, comprising:

an elongate, substantially rectangular center body of a first thickness;

a first and second handle structure extending from the longitudinal ends of said center body each of a second thickness and each including a recess therein, said second thickness being less than one half of said first thickness and a first and second opening formed in said center body proximate said first and second handle structure for reducing the section of said body thereat.

5. An ingot form according to claim 4 wherein:

said center body and said first and second handle structures each include a common surface and each include peripheral edges tapered inwardly from said common surface.

* * * * *